US007215526B2

(12) United States Patent
Constantinos et al.

(10) Patent No.: US 7,215,526 B2
(45) Date of Patent: May 8, 2007

(54) ION GENERATOR WITH OPEN EMITTER AND SAFETY FEATURE

(75) Inventors: Joannou Constantinos, Ottawa (CA); Rudy A. Vandenbelt, Ottawa (CA); Ross L. Cowie, Ottawa (CA); Charles R. Lanning, Ottawa (CA)

(73) Assignee: Headwaters, Inc., Marblehead, MA (US)

( * ) Notice: Subject to any disclaimer, the term of this patent is extended or adjusted under 35 U.S.C. 154(b) by 0 days.

(21) Appl. No.: 10/908,730

(22) Filed: May 24, 2005

(65) Prior Publication Data

US 2006/0268490 A1 Nov. 30, 2006

(51) Int. Cl.
*H01T 23/00* (2006.01)
*H05F 3/00* (2006.01)

(52) U.S. Cl. ..... 361/231; 361/230

(58) Field of Classification Search ..... 361/231
See application file for complete search history.

(56) References Cited

U.S. PATENT DOCUMENTS

| | | | | |
|---|---|---|---|---|
| 4,907,498 | A * | 3/1990 | Haufe | 454/156 |
| 6,897,783 | B2 * | 5/2005 | Zeng et al. | 340/635 |
| 6,919,053 | B2 * | 7/2005 | Joannou | 422/186 |
| 2006/0078460 | A1 * | 4/2006 | Ryu et al. | 422/5 |

* cited by examiner

*Primary Examiner*—Stephen W Jackson
*Assistant Examiner*—Dharti H. Patel
(74) *Attorney, Agent, or Firm*—Albert Peter Durigon

(57) ABSTRACT

The invention is directed towards an efficient and ozone free ion generator in which the ion emitter is open to the surrounding space while the collector is provided by electrical ground remote and away from the ion emitter. In the case of a household generator, the ground is the electrical ground of the house. In the case of a car generator, the ground is the car frame. A safety circuit is arranged to turn the high voltage off if a hand or other body member (or pet) comes near or touches the exposed emitter to prevent electrical shock.

13 Claims, 2 Drawing Sheets

PREVIOUS ART

ION GENERATOR WITH OPEN EMITTER AND SAFETY FEATURE

FIELD OF THE INVENTION

This invention relates to ion generators, and more particularly, to negative ion generators where a high voltage power supply is connected to a sharp point to produce ions.

BACKGROUND OF THE INVENTION

It is well known that a high voltage, in the range of a few thousand volts, applied to a sharp point produces ions in the surrounding air. A lot of negative ion generators based on this principle exist in the marketplace. They generally consist of a high voltage power supply of which its negative terminal is connected to a sharp point, usually that of a needle, and its positive terminal is connected to an electrode, typically a ring (collector), in front of the needle. Sometimes this is duplicated a few times in a typical unit. Many negative ion generators of which I am aware, mainly for car use, are of this type.

Having the positive electrode, a ring, in front of the negative needle, a short path is made from the needle(s) to the ring(s). This causes two major problems. First, the ions coming out of the needle(s) get readily absorbed by the ring(s) (collectors) and much less ions get through the ring(s) to be of benefit, resulting in inefficient ion generation. Second, the proximity of the opposite collector electrode (ring(s)) to the emitter(s) creates a high differential voltage gradient which, due to the high velocity of the ions bombarding the oxygen molecules of the air between the electrodes, produces ozone.

SUMMARY OF THE INVENTION

It is one object of my invention to provide an ion generator that floods an interior with cleansing ions much more voluminously than heretofore.

It is another object to provide an ion generator that eliminates ozone generation.

It is another object to provide an ion generator that is safe to use.

It is a further object of the present invention to provide an ion generator comparatively inexpensive to manufacture suitable for mass distribution.

In accord with my invention, a very large gap is provided between the ion emitter and the opposing electrode of my ion generator. The emitter of the ion generator is exposed to the open space of an interior to be cleaned and the opposing electrode of the ion generator is provided by the electrical ground of the walls bounding the interior to be cleaned, such as the electrical ground of the walls of a house or chassis of a motor vehicle at least partially bounding the interior to be cleaned. All ions generated fly off the exposed and electrically unobstructed emitter and then spread out in all directions until they meet the walls of the house or the frame of the car, capturing dust and other particulates on the way, thereby removing the particulate matter from the interior to be cleaned in a highly efficient manner without producing ozone.

In further accord with my invention, I have devised safety circuitry preventing people from getting a shock if they touch or get near to the open exposed emitter. The safety circuit prevents people (or animals) from getting a shock if they touch or approach the point source ion emitter by sensing the extra current that flows through the exposed emitter because of the proximity to the hand and by shutting the high voltage off for a predetermined time, typically a few seconds, or until the hand (or other body part) is removed from proximity with the exposed electrode of my invention.

BRIEF DESCRIPTION OF THE DRAWINGS

These and other objects, inventive aspects and advantageous features of my invention will become apparent as the invention becomes better understood by referring to the following, solely exemplary, detailed description of the presently preferred embodiments thereof, and to the drawings, wherein.

DETAILED DESCRIPTION OF THE PRESENTLY PREFERRED EMBODIMENTS

Figure 1:
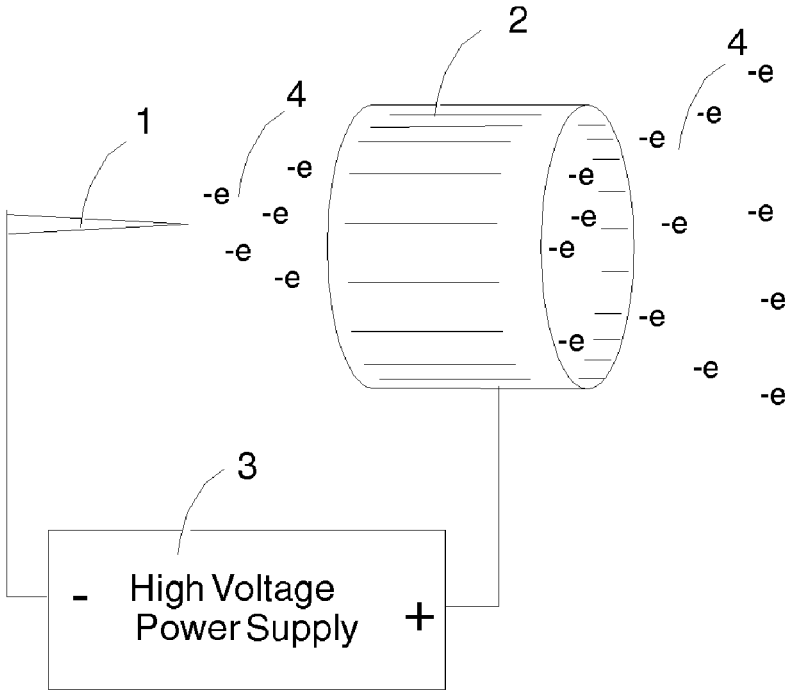
FIG. 1 shows a previous art ion generator where the ion emitter (needle) is near the collector (ring)

In FIG. 1, the numeral 1 designates an ionizing emitter, typically a needle, and the numeral 2 designates the collector ring (counter electrode) which is in proximity to the needle 1 of a prior art ion generator. Such prior art ion generators smell of ozone and represent an inefficient way to induce cleansing ions into the air of an environment to be cleaned.

High voltage power supply 3 provides high voltage to the ionizing needle 1 and to the collector ring 2. Electrons designated at 4 coming out of the needle 1 are attracted by the opposite polarity of the ring 2 and are focused in the direction of the ring 2; some electrons are dissipated in the ring 2 and others get through to the outside. At the same time, because of the proximity of the counter electrode (the collector ring 2) to the ionizing needle 1, the voltage gradient between the needle 1 and the counter electrode is high enough to accelerate the electrons to break the bonds of oxygen contained in the air between the needle 1 and the counter electrode, which generates ozone.

Figure 2:
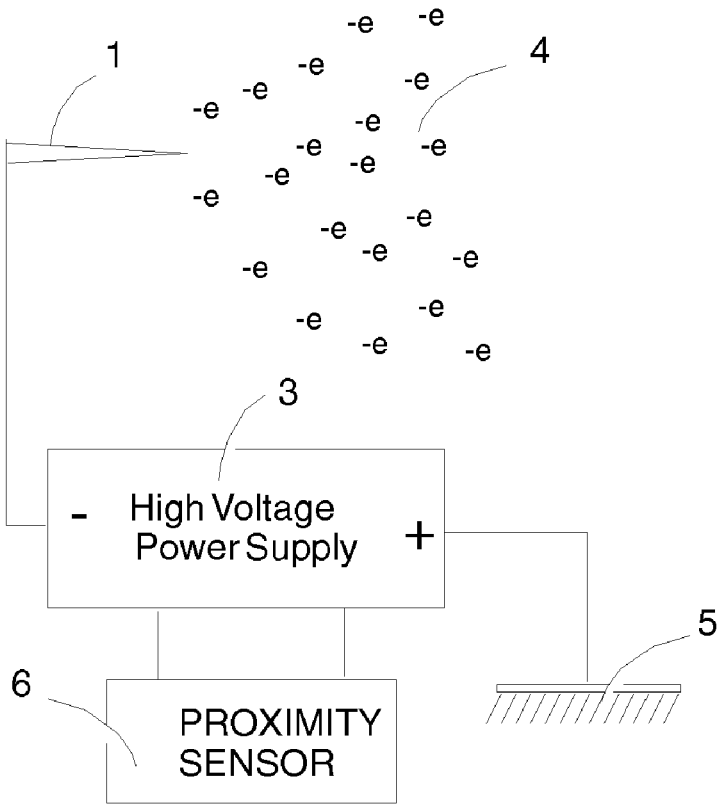
FIG. 2 is a block diagram of my invention, which shows an ion generator wherein the ion emitter is exposed and far away from the collector (ground) and including the proximity sensor.

FIG. 2 shows an arrangement of my invention where the ion emitter 1 and the counter electrode 5 are far apart, where the numeral 5 designates a ground base or common ground which could be, for example, the wiring ground of a house or the chassis frame of a car or the electrical ground of some other interior in which it is desirable or advantageous to use my invention. Ions coming out of the exposed needle 1 have a long way to travel to reach the ground 5 and thus flood the interior space with a lot more cleansing ions than the prior art ion generator described above in connection with the description of FIG. 1, without producing ozone in the process. Proximity detector (safety circuit) 6 to be described is operatively connected to the high voltage supply 3 to prevent electrical shocks. Power may be supplied by any available or suitable AC or DC means. Depending on the implementation, the path from supply 3 to ground 5 may be by ground leakage currents or by conductor or some other means or mechanism.

Figure 3:
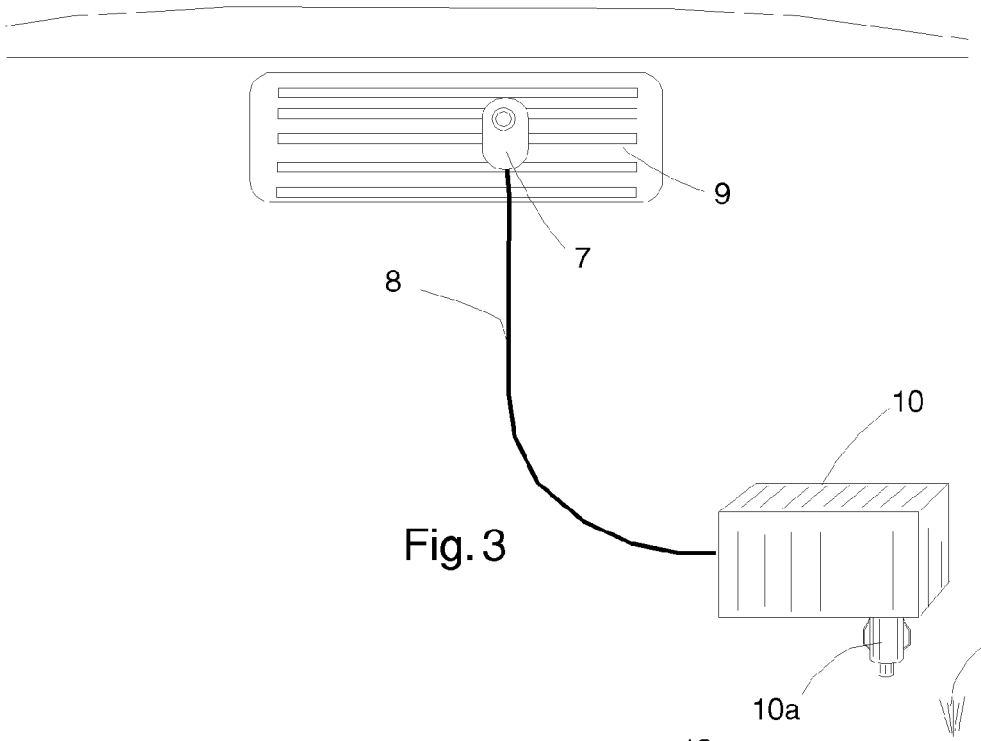
FIG. 3 shows a variation of my invention where the ion emitter is attached to the air vent of a car.

FIG. 3 shows a car ionizer where the emitting electrode 7, in this case a brush with conductive bristles, is connected to the suitably housed end of a conductive cord 8. The brush emitting electrode 7 is attached by any suitable means such as a clip attached to or part of the housed end of the cord 8 to the car vent 9 so that the ions coming out of it will spread out better due to the air flow from the vent. Of course, the electrode 7 may be otherwise positioned in the car's interior to take advantage of the air flow or be differently positioned, arranged or provisioned.

The brush emitting electrode 7 and a connector 10 are electrically connected to a suitably housed power supply 10 adapted for attached or freestanding use inside a vehicle. The connector 10*a*, adapted for connecting to the vehicle's cigarette lighter accessory or other plug, electrically connects the ion generator's power supply to the vehicle's chassis (electrical ground).

The electrode 7, exposed at the car air vent 9 or other location exposed to the car's air stream or other advantageous location exposed into the open space of the car's interior, fills the interior space with cleansing ions. The ions, attracted towards electrical ground, efficiently remove dust, smoke or other particulate pollutants from the entirety of the car's interior as the ions move towards the vehicle's frame. A safety circuit to be described is provided to prevent electrical shock should a hand or other body member (or animal) touch or approach the exposed electrode 7.

Figure 4:
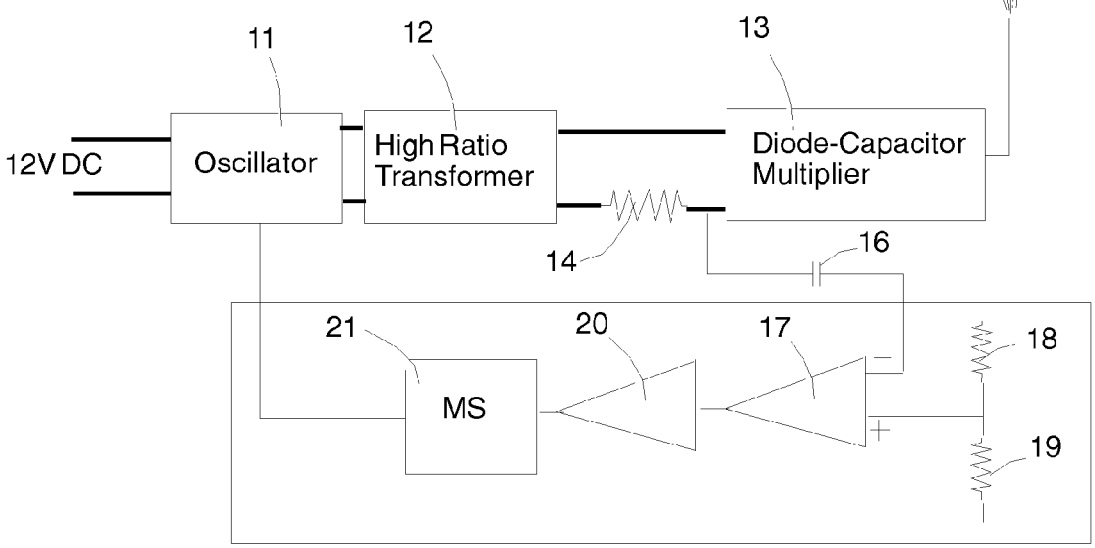
FIG. 4 is an electrical block diagram of the safety (proximity sensor) circuit in accord with my invention.

FIG. 4 shows the complete electronic arrangement of my invention in block diagram. An oscillator 11 coupled to the vehicle's accessory plug drives high turns ratio transformer 12. The output of transformer 12 is connected to diode-capacitor multiplier 13, which rectifies and multiplies the voltage from about one (1) KV to ten (10) KV direct current. One of the input leads of the diode-capacitor multiplier 13 is connected to transformer 12 via a resistor 14. The current driving the diode-capacitor multiplier 13 passes through resistor 14.

Resistor 14 develops a voltage across it which is proportional to the current going to the emitter 15. If, for example, a hand comes near emitter 15, because of the sudden increase of current in resistor 14, a voltage surge appears across resistor 14. This voltage increase passes through capacitor 16.

A voltage comparator 17 is provided with threshold setting resistors 18 and 19. If the voltage through the capacitor 16 exceeds the threshold, the comparator 17 gives a pulse to amplifier 20. The output of amplifier 20 triggers monostable multivibrator 21.

Monostable multivibrator 21 produces a pulse that is made to stop the oscillator 11 for preferably a few seconds and therefore the high voltage is interrupted during this time. After the pulse is gone, the oscillator starts again and if the hand is still there the process continues until the hand is moved away.

It is possible to connect more than one emitter in parallel on the high voltage power supply. The effect will be the same no matter which emitter is approached.

Many modifications of the presently disclosed invention will become apparent to those of skill in the art without departing from the scope and spirit of the present invention.

We claim:

1. An ion generator flooding an interior of a habitable space to be cleaned with cleansing ions without producing ozone, said interior to be cleaned of said habitable space at least partially provided by boundary walls defined by electrical ground, comprising:

a) a high voltage power supply having opposite polarity ports and providing an ionizing potential, wherein one of said opposite polarity ports is adapted to be electrically coupled to the potential of said electrical ground and the other of said opposite polarity ports provides said ionizing potential;

b) an ion emitter electrically connected to said one of said ports of opposite polarity of said power supply supplying said ionizing potential so that it floods said interior with cleansing ions when placed in said interior of said habitable space, which ions, attracted towards said electrical ground which serves as the counter electrode, efficiently remove dust, smoke or other particulate pollutants from substantially the entirety of said interior of said habitable space as the ions move towards said electrical ground and become captured on said boundary walls; and c) a safety circuit coupled to said high voltage power supply and operative in response to proximity of a human being in said habitable space near said ion emitter to turn off said power supply for a predetermined period of time to prevent electrical shock.

2. The ion generator of claim 1, wherein said habitable interior is the interior of a motor vehicle having a chassis and said electrical ground is defined by the electrical ground potential of the chassis of said vehicle.

3. The ion generator of claim 1, wherein said habitable interior is the interior of a non-moving structure having a wiring ground and said electrical ground is defined by the electrical potential of the wiring ground of said structure.

4. The ion generator of claim 1, further including a housing, and wherein said ion emitter and said high voltage power supply are mounted in common to said housing.

5. The ion generator of claim 1, further including a first housing and a second housing physically separated and mechanically distinct from said first housing, wherein said ion emitter is mounted to said first housing and wherein said high voltage power supply is mounted in said second housing, and further including an elongated electrical connector connecting said ion emitter mounted to said first housing to said one of said ports of opposite polarity of said power supply supplying said ionizing potential of said second housing physically separated and mechanically distinct from said first housing.

6. The ion generator of claim 2, further including means for mounting said ion emitter in a predetermined location of said habitable interior of said vehicle.

7. The ion generator of claim 6, wherein said vehicle includes an air vent, and wherein said predetermined location is one of the vehicle's air vents.

8. The ion generator of claim 2, further including a connector electrically connected to said high voltage power supply to connect to ground potential said one of said ports of opposite polarity adapted to be electrically coupled to ground potential.

9. The ion generator of claim 8, wherein said vehicle has an accessory plug and wherein said connector is adapted to connect to said accessory plug of said vehicle.

10. The ion generator of claim 1, wherein said ion emitter is made of a conductive brush.

11. The ion generator of claim 1, wherein said one of said opposite polarity ports adapted to be electrically coupled to the potential of said electrical ground is coupled to said potential by leakage currents.

12. The ion generator of claim 1, wherein said one of said opposite polarity ports adapted to be electrically coupled to the potential of said electrical ground is coupled to said potential by an electrical connector.

13. The ion generator of claim 12, wherein said connector includes an elongated, flexible electrical connector.

* * * * *